US007488226B2

(12) United States Patent
Perkins, II

(10) Patent No.: US 7,488,226 B2
(45) Date of Patent: Feb. 10, 2009

(54) PROPELLER SHIELD APPARATUS FOR TROLLING MOTOR

(75) Inventor: Paul Simon Perkins, II, Downers Grove, IL (US)

(73) Assignee: Raptor Fishing Technologies, Inc., Downers Grove, IL (US)

( * ) Notice: Subject to any disclaimer, the term of this patent is extended or adjusted under 35 U.S.C. 154(b) by 0 days.

(21) Appl. No.: 11/715,773

(22) Filed: Mar. 8, 2007

(65) Prior Publication Data

US 2008/0220670 A1 Sep. 11, 2008

(51) Int. Cl.
*B63H 5/16* (2006.01)

(52) U.S. Cl. ..... 440/71

(58) Field of Classification Search ..... 440/6, 440/71, 72, 67; D15/4; D12/317
See application file for complete search history.

(56) References Cited

U.S. PATENT DOCUMENTS

| | | | | |
|---|---|---|---|---|
| 619,329 | A | | 2/1899 | Moore |
| 682,027 | A | | 9/1901 | Burgess |
| 904,313 | A | | 11/1908 | Davis |
| 1,226,400 | A | | 5/1917 | Smith |
| 2,096,223 | A | | 10/1937 | Chandler et al. |
| 2,096,457 | A | | 10/1937 | Irgens |
| 2,956,533 | A | | 10/1960 | De Yo |
| 3,742,895 | A | | 7/1973 | Horiuchi |
| 3,768,432 | A | * | 10/1973 | Spaulding ..... 440/66 |
| 3,955,527 | A | | 5/1976 | Holtermann |
| 4,013,033 | A | * | 3/1977 | Porter et al. ..... 440/72 |
| 4,031,846 | A | | 6/1977 | Tone |
| 4,070,984 | A | * | 1/1978 | Kappas ..... 440/72 |
| 4,487,152 | A | | 12/1984 | Larson |
| 4,553,945 | A | | 11/1985 | Foster |
| 4,744,779 | A | | 5/1988 | Koehler |
| 4,756,265 | A | | 7/1988 | Lane |
| 4,995,840 | A | | 2/1991 | Seale et al. |
| 5,102,359 | A | | 4/1992 | Hinds |
| 5,203,275 | A | | 4/1993 | Brauner et al. |
| 5,667,415 | A | | 9/1997 | Arneson |
| 5,902,157 | A | | 5/1999 | Boris |
| 2006/0166570 | A1 | | 7/2006 | Norman |
| 2006/0166571 | A1 | | 7/2006 | Norman et al. |

* cited by examiner

*Primary Examiner*—Ed Swinehart
(74) *Attorney, Agent, or Firm*—Erickson Law Group, PC

(57) ABSTRACT

A propeller shield apparatus for mounting to a trolling motor having an exposed propeller with a horizontal axis includes a vertical fin and an arcuate propeller shield. The arcuate propeller shield is oriented concave downward and fixed to the vertical fin. The vertical fin is carried by the trolling motor. The vertical fin spaces the propeller shield above the propeller. A curved bracket is provided, connected to the vertical fin, and is clamped to the trolling motor. Angular fins can be provided at opposite ends of the propeller shield which extend substantially radially from the horizontal axis.

19 Claims, 5 Drawing Sheets

PROPELLER SHIELD APPARATUS FOR TROLLING MOTOR

TECHNICAL FIELD OF THE INVENTION

This invention relates to trolling motors for boats. Particularly, the invention relates to an attachment for a trolling motor.

BACKGROUND OF THE INVENTION

Trolling motors for fishing boats are well known in the art and have been used by fishermen for many years. Trolling motors are typically small, low power insulated electric motors which are mounted on the lower end of a hollow tube or shaft. The electric motor drives a rotatable propeller at the rearward end of the motor body. Power cables extend through the tube to supply power to the motor. During use, the tube is vertically aligned so that the motor body is submerged beneath the water. The tube is configured to be rotatable to change the direction of thrust of the propeller to steer the boat. A trolling motor can also include a rudder to assist in the steering of the boat. A trolling motor is typically used during fishing to slowly and quietly maneuver the boat over short distances. A complete description of a trolling motor is provided by U.S. Pat. No. 7,056,166 B2.

When a trolling motor is not in use it can be pivoted up to where the tube is oriented horizontally and the motor is removed from the water.

The present inventor has recognized that it would be desirable to provide a trolling motor attachment that increases the usefulness of a trolling motor. The present inventor has recognized that it would be desirable to provide a trolling motor that is more reliably operable in shallow water and that increases the maneuverability and stability of the boat attached thereto. The present inventor has recognized that it would be desirable to provide a trolling motor attachment that is rugged, easy to install onto a trolling motor and is economically manufactured.

SUMMARY OF THE INVENTION

The invention provides a propeller shield apparatus for mounting to a trolling motor having an exposed propeller with a horizontal axis. The propeller shield apparatus comprises a vertical fin and an arcuate propeller shield. The arcuate propeller shield is oriented concave downward and fixed to the vertical fin. Means are provided to mount the vertical fin to the trolling motor. The vertical fin spaces the propeller shield above the propeller.

Preferably, the means includes a bracket connected to the vertical fin that is clamped or otherwise connected or fastened to the trolling motor. Preferably, the bracket has a curvature to conform to the outside of the trolling motor and is clamped closely thereto.

Angular fins can be connected to, or formed with, opposite ends of the propeller shield. The angular fins extend upwardly substantially radially to the horizontal axis of the propeller. The angular fins are preferably oriented at about 90 degrees to a top surface of the propeller shield.

Preferably, the propeller shield is substantially semi-cylindrical.

Preferably, the bracket comprises a semi-cylindrical body portion and further comprises at least one adjustable band clamp that is arranged to tightly encircle the curved bracket and the trolling motor.

Preferably the bracket includes a recess for receiving a vertical post of the trolling motor.

Preferably the vertical fin extends both above and below the propeller shield.

Preferably, the propeller shield apparatus is constructed of aluminum, stainless steel, or reinforced plastic.

The vertical fin enhances steering control while the trolling motor is under power. The vertical fin decreases the effect of water current and wind when trolling motor is under powered or un-powered.

The horizontal curved propeller shield reduces the amount of air ingested into the trolling motor propeller, when under power, allowing the trolling motor to operate in shallower depths of water.

The horizontal curved propeller shield reduces the amount of bow uplift in choppy water and waves while trolling motor is under power or un-powered. The propeller shield apparatus acts as a sea anchor stabilizing the bow of the boat.

The propeller shield apparatus can universally mount to most trolling motors, as an after market assembly or as a direct mount, factory installed assembly. The semi-cylindrical mounting bracket attaches to most commercially available trolling motors.

The propeller shield apparatus does not need to be removed while the trolling motor is in a tipped-up, stowed position.

Numerous other advantages and features of the present invention will be become readily apparent from the following detailed description of the invention and the embodiments thereof, the claims and from the accompanying drawings.

DETAILED DESCRIPTION OF THE PREFERRED EMBODIMENTS

Figure 1:
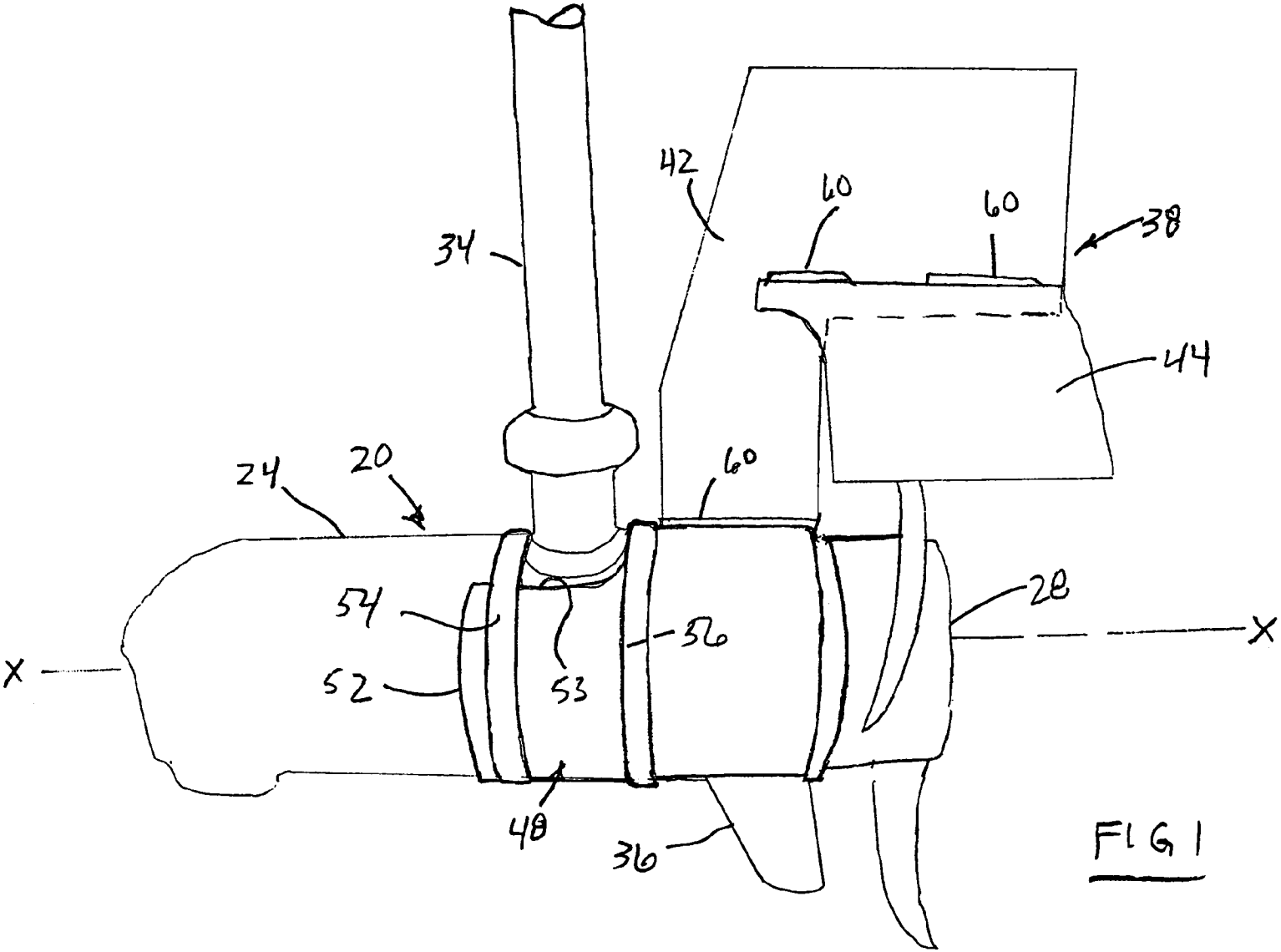
FIG. 1 is a fragmentary perspective side view of a propeller shield apparatus of the present invention mounted to a trolling motor.
Figure 2:
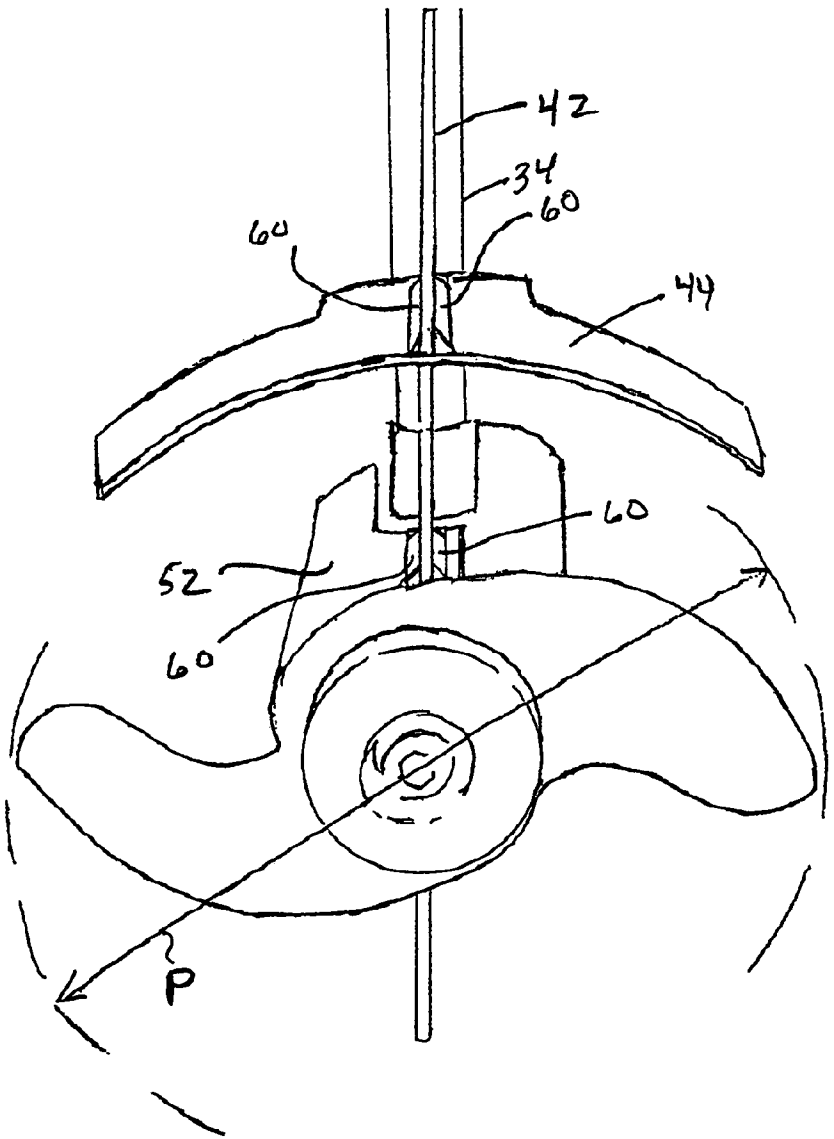
FIG. 2 is a fragmentary perspective rear view of the propeller shield apparatus and trolling motor of FIG. 1.
Figure 3:
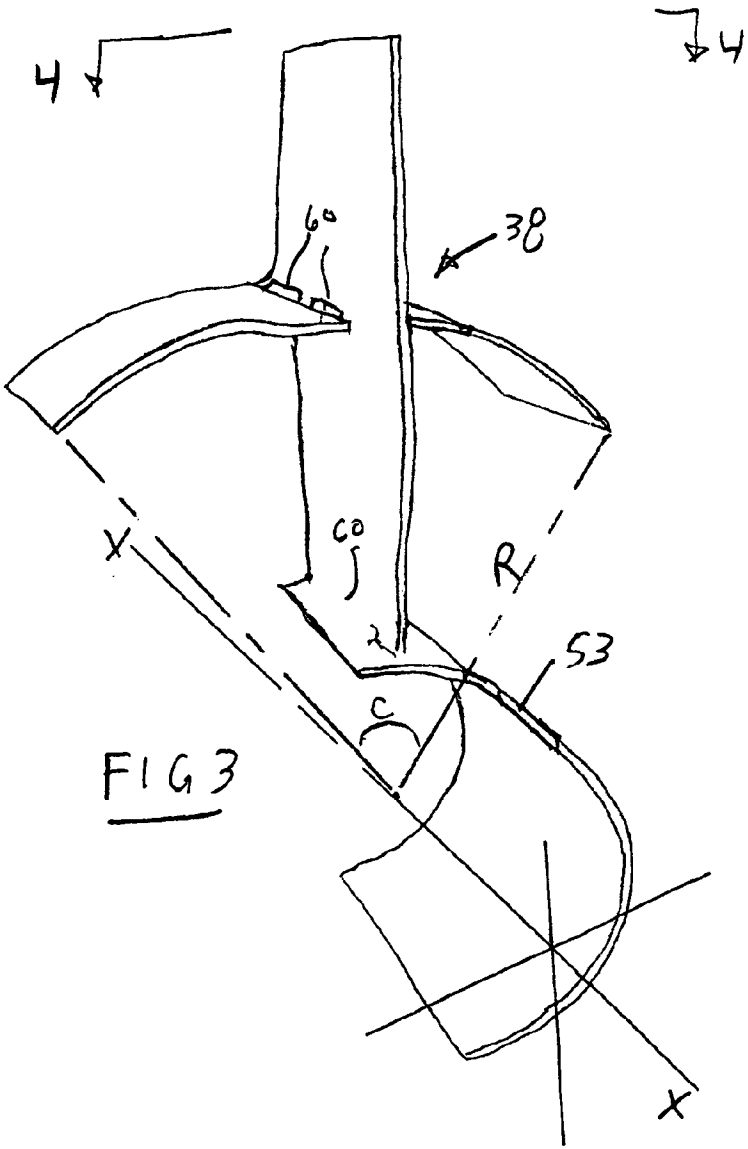
FIG. 3 is a front perspective view of the propeller shield apparatus shown in FIG. 1.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates a portion of a trolling motor 20 that includes a motor housing 24 that contains an electric motor, an exposed propeller 28 and a control post 34. The control post 34 provides a conduit for electric power to the motor housing 24 and also allows for turning of the housing 24 to steer the boat. The housing 24 can be provided with a bottom fin 36. A complete description of a trolling motor is provided by U.S. Pat. No. 7,056,166 B2, herein incorporated by reference.

As illustrated in FIGS. 1-4, according to the invention, a propeller shield apparatus 38 is fastened to the motor housing 24. The propeller shield apparatus 38 includes a vertical fin 42, an arcuate propeller shield 44 connected to the vertical fin 42, and a clamp assembly 48 connected to the vertical fin and clamped to the motor housing 24.

The clamp assembly 48 includes a C-shaped or semi-cylindrical bracket 52 and two band clamps 54, 56. The band clamps 54, 56 are commercially available hose or duct clamps that are screw activated to constrict to tighten around the bracket 52 and the housing 24.

The parts 42, 44, 52 can be all welded together. Welds 60 are shown as examples.

Figure 5:
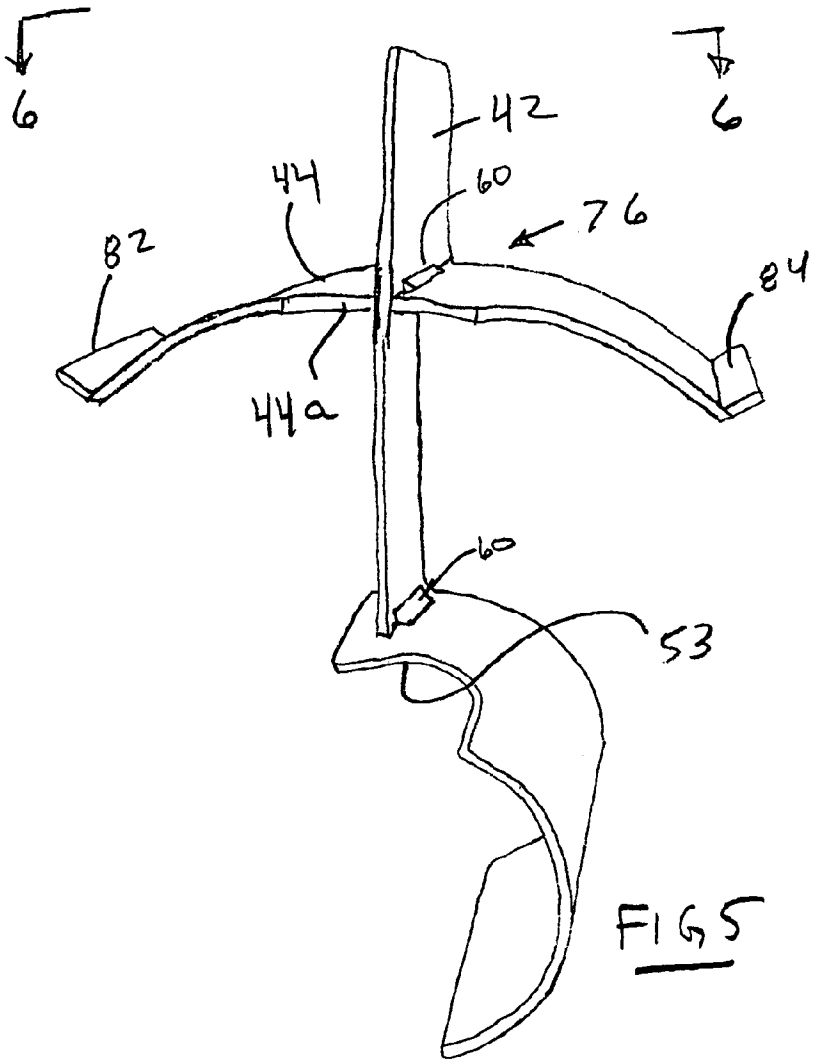
FIG. 5 is a front perspective view of an alternate embodiment propeller shield apparatus.
Figure 4:
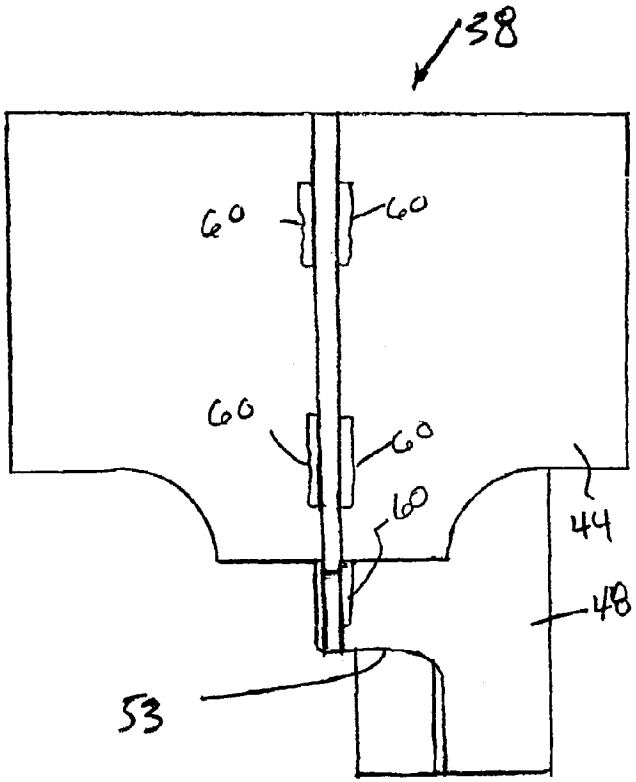
FIG. 4 is a top view taken generally along line 4-4 of FIG. 3.
Figure 6:
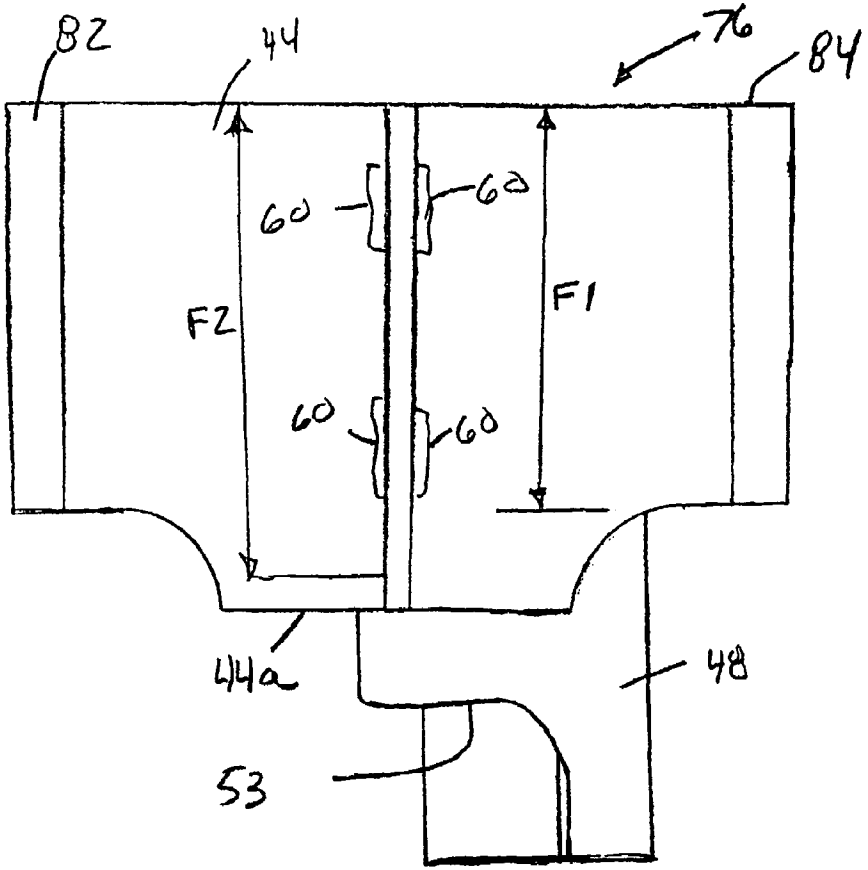
FIG. 6 is a top view taken generally along line 6-6 of FIG. 5.

FIGS. 5 and 6 illustrate an alternate embodiment of the propeller shield apparatus, propeller shield apparatus 76. Like parts carry the same reference numbers or letters as in the first embodiment. This assembly 76 is substantially similar to the assembly 38 except that angled fins 82, 84 are bent off from the propeller shield material, or otherwise formed in unitary fashion with the propeller shield, or can be separate plates welded to, or otherwise fixed to, ends of the arcuate propeller shield 44. Additionally, the vertical fin 42 in the alternate embodiment is substantially flush with the front edge 44*a* of the propeller shield 44.

Preferably, the angled fins 82, 84 have a matching depth with the propeller shield 44. The angled fins 82, 84 extend substantially radially from a centerline or axis X of the propeller 28 and motor housing 24. The angled fins 82, 84 extend substantially at about 90 degrees from the top surface of the propeller shield 44.

Figure 7:
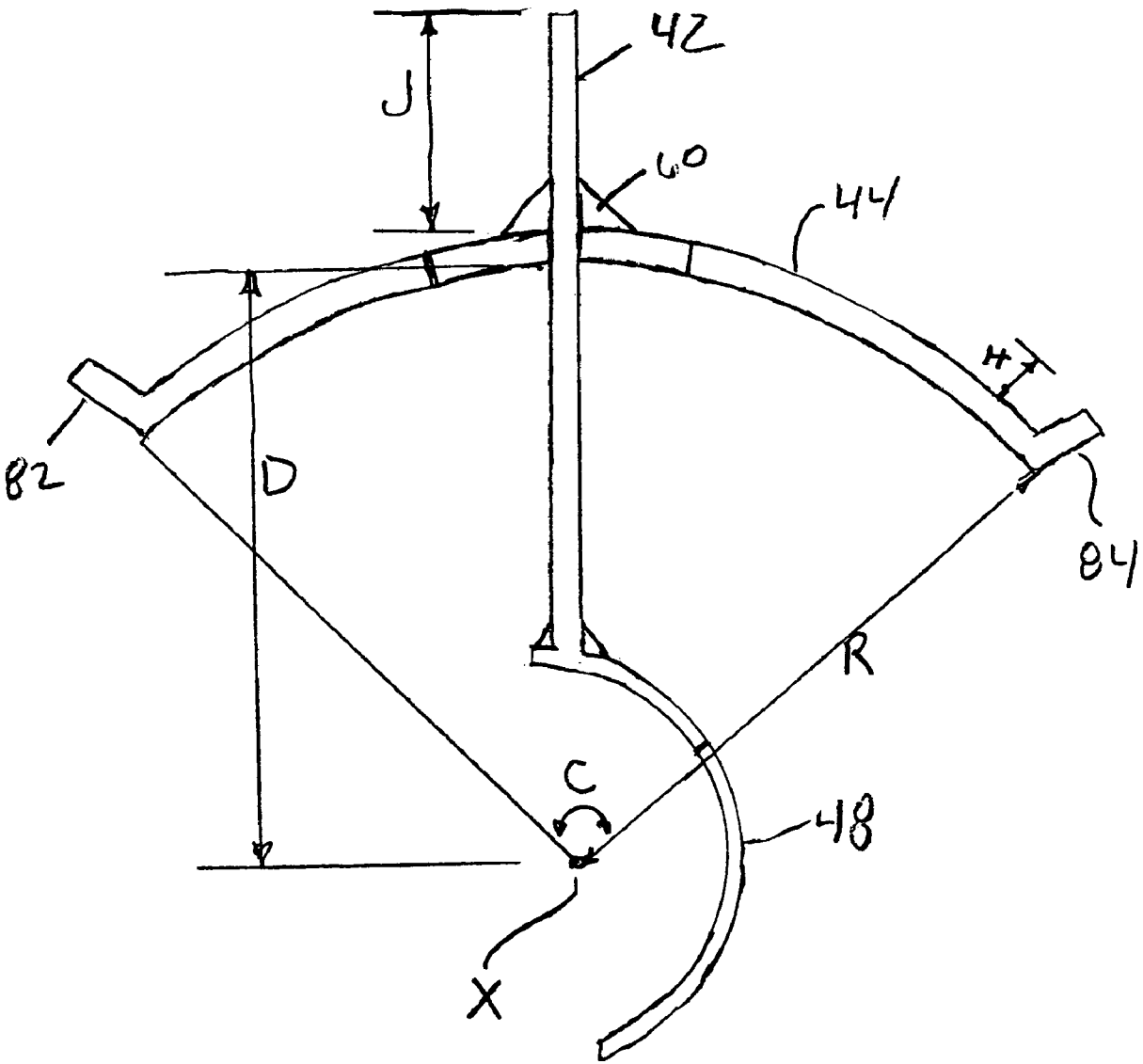
FIG. 7 is a front view of the alternate embodiment propeller shield apparatus of FIG. 5.

As shown in FIG. 7, the propeller shield 44 has an inside radius of curvature R of about 5.5 to 7 inches, preferably 6.5 inches, and an arc C of about 60 to 180 degrees, preferably 90 degrees. The propeller shield is set at a vertical distance D of about 5.5 to 7 inches, preferably 6.5 inches from the centerline X of the motor housing 24, wherein the propeller shield can be curved around the same centerline X. According to this example, the propeller 28 has a rotating circumference P (FIG. 2) of about 11 inches. According to the illustrated embodiment, the radius R being 6.5 inches allows a clearance of about 1 inch between the rotating propeller 28 and the shield 44.

A narrow portion of the propeller shield 44 and the angled fins 82, 84 have a depth F1 as shown in FIG. 6 of about 5 inches. The vertical fin above the shield 44 has an average depth F2, given that it tapers back slightly in vertical rise, as shown in FIG. 6, of about 6¾ inches.

The angled fins 82, 84 have heights H of about 0.5 inches taken normal to an adjacent top surface of the propeller shield 44. The vertical fin 42 has a height J above the propeller shield 44 of about 3 inches.

Preferably, when the propeller shield apparatus is composed of aluminum, the thickness of the vertical fin 42 is about 3/16 inches, the thickness of the propeller shield 44 is about ⅛ inches, and the thickness of the bracket 52 is about ⅛ inches.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A propeller shield apparatus for mounting to a trolling motor having an exposed propeller with a horizontal axis, comprising:

a vertical fin;

an arcuate, substantially imperforate propeller shield oriented concave downward and fixed to said vertical fin, said vertical fin extending below said shield; and a curved bracket fixed to said vertical fin and configured to be clamped to said trolling motor;

wherein said vertical fin spaces said propeller shield above said propeller reducing air intake into said propeller when said trolling motor is operated in shallow water.

2. The propeller shield apparatus according to claim 1, further comprises angular fins connected to opposite ends of said propeller shield, said angular fins oriented substantially radially to the horizontal axis.

3. The propeller shield apparatus according to claim 1 wherein said propeller shield is substantially semi-cylindrical, having a radius of between about 5.5 to 7 inches.

4. The propeller shield apparatus according to claim 3 further comprises angular fins connected to opposite ends of said propeller shield, said angular fins oriented substantially radially to the horizontal axis, said angular fins having a height extending above a top surface of said propeller shield of about 0.5 inches.

5. The propeller shield apparatus according to claim 1, wherein said curved bracket comprises a semi-cylindrical body portion and further comprising at least one adjustable band clamp.

6. The propeller shield apparatus according to claim 5, wherein said curved bracket includes a recess for receiving a vertical post of said trolling motor.

7. The propeller shield apparatus according to claim 1, wherein said propeller shield is substantially semi-cylindrical having a radius of between about 5.5 to 7 inches, and an arc of between about 60 and 180 degrees.

8. The propeller shield apparatus according to claim 1, wherein said propeller shield is substantially semi-cylindrical having a radius of between about 5.5 to 7 inches, and an arc of between about 60 and 180 degrees, and said vertical fin supports said propeller shield above a centerline of said motor body a distance of about 5.5 to 7 inches.

9. The propeller shield apparatus according to claim 1, wherein said propeller shield has a first depth dimension equal to or greater than a second depth dimension of said exposed propeller, said first and second depth dimensions measured parallel to said horizontal axis in a vertical plane that contains said horizontal axis.

10. A propeller shield apparatus for mounting to a trolling motor having an exposed propeller with a horizontal axis, comprising:

a vertical fin;

an arcuate propeller shield oriented concave downward and fixed to said vertical fin; and a curved bracket fixed to said vertical fin and configured to be clamped to said trolling motor;

wherein said vertical fin spaces said propeller shield above said propeller, wherein said vertical fin extends above said propeller shield.

11. The propeller shield apparatus for mounting to a trolling motor having an exposed propeller with a horizontal axis, comprising:

a vertical fin configured to be carried by said trolling motor;

an arcuate, substantially imperforate propeller shield oriented concave downward and fixed to said vertical fin, said vertical fin extending below said shield;

angular fins connected to opposite ends of said propeller shield, said angular fins oriented at about 90 degrees to a top surface of said propeller shield; and wherein said vertical fin spaces said propeller shield above said propeller reducing air intake into said propeller when said trolling motor is operated in shallow water.

12. The propeller shield apparatus according to claim 11 wherein said propeller shield is substantially semi-cylindrical, having a radius of between about 5.5 to 7 inches.

13. The propeller shield apparatus according to claim 12, wherein said angular fins are oriented substantially radially to the horizontal axis, said angular fins having a height extending above a top surface of said propeller shield of about 0.5 inches.

14. The propeller shield apparatus according to claim 11, further comprising a bracket connected to said vertical fin, wherein said bracket comprises a semi-cylindrical body portion arranged to partially encircle the trolling motor.

15. The propeller shield apparatus according to claim 14, wherein said bracket includes a recess for receiving a vertical post of said trolling motor.

16. The propeller shield apparatus according to claim 11, wherein said propeller shield is substantially semi-cylindrical having a radius of between about 5.5 to 7 inches, and an arc of about 90 degrees.

17. The propeller shield apparatus according to claim 11, wherein said propeller shield has a first depth dimension equal to or greater than a second depth dimension of said exposed propeller, said first and second depth dimensions measured parallel to said horizontal axis in a vertical plane that contains said horizontal axis.

18. A propeller shield apparatus for mounting to a trolling motor having an exposed propeller with a horizontal axis, comprising:

a vertical fin configured to be carried by said trolling motor; and an arcuate, substantially impertorate propeller shield oriented concave downward and fixed to said vertical fin, said vertical fin extending below said shield;

wherein said vertical fin spaces said propeller shield above said propeller reducing air intake into said propeller when said trolling motor is operated in shallow water; and wherein said propeller shield is substantially semi-cylindrical having a radius of about between about 5.5 to 7 inches, and an arc of about 90 degrees, and said vertical fin supports said propeller shield above a centerline of said motor body a distance of between about 5.5 to 7 inches.

19. A propeller shield apparatus for mounting to a trolling motor having an exposed propeller with a horizontal axis, comprising:

a vertical fin configured to be carried by said trolling motor, said vertical fin comprising a thin plate of substantially constant thickness; and an arcuate propeller shield oriented concave downward and fixed to said vertical fin;

wherein said vertical fin spaces said propeller shield above said propeller, wherein said vertical fin extends above said propeller shield.

* * * * *